US008474086B1

(12) United States Patent
Smith

(10) Patent No.: US 8,474,086 B1
(45) Date of Patent: Jul. 2, 2013

(54) COMPOSITE BRISTLE

(75) Inventor: Karey J. Smith, Lakeland, FL (US)

(73) Assignee: Smith Equipment & Supply Company, Lakeland, FL (US)

( * ) Notice: Subject to any disclaimer, the term of this patent is extended or adjusted under 35 U.S.C. 154(b) by 611 days.

(21) Appl. No.: 12/660,190

(22) Filed: Feb. 22, 2010

Related U.S. Application Data

(60) Provisional application No. 61/208,726, filed on Feb. 27, 2009.

(51) Int. Cl.
*A46B 13/02* (2006.01)
*A46B 15/00* (2006.01)

(52) U.S. Cl.
USPC ..... 15/207.2; 15/78; 15/179

(58) Field of Classification Search
USPC ..... 15/78, 79.1, 79.2, 207.2, 179
See application file for complete search history.

(56) References Cited

U.S. PATENT DOCUMENTS

| | | | | |
|---|---|---|---|---|
| 3,005,274 | A | 10/1961 | Kershaw | |
| 3,090,061 | A * | 5/1963 | Charvat | 15/207.2 |
| 3,228,053 | A | 1/1966 | Horton | |
| 3,237,232 | A | 3/1966 | Holley | |
| 3,649,984 | A | 3/1972 | Kershaw et al. | |
| 4,144,610 | A | 3/1979 | Moore et al. | |
| 4,184,223 | A | 1/1980 | Price | |
| 4,285,737 | A | 8/1981 | Price | |
| 4,484,373 | A | 11/1984 | Price | |
| 4,524,480 | A * | 6/1985 | Bloom | 15/207.2 |
| 4,619,217 | A | 10/1986 | Wachi | |
| 5,540,004 | A | 7/1996 | Patterson et al. | |

* cited by examiner

*Primary Examiner* — Randall Chin
(74) *Attorney, Agent, or Firm* — Frijouf, Rust & Pyle, P.A.

(57) ABSTRACT

A composite bristle and a method of making is disclosed comprising a metallic bristle embedded within a generally central region of a polymeric bristle. A periodic bend is formed along the length of each of the composite bristles. The invention is also incorporated into a composite brush and a method of making.

13 Claims, 6 Drawing Sheets

COMPOSITE BRISTLE

CROSS-REFERENCE TO RELATED APPLICATIONS

This application claims benefit of U.S. Patent Provisional application Ser. No. 61/208,726 filed Feb. 27, 2009. All subject matter set forth in provisional application Ser. No. 61/208,726 filed Feb. 27, 2009 is hereby incorporated by reference into the present application as if fully set forth herein.

BACKGROUND OF THE INVENTION

1. Field of the Invention

This invention relates to brush bristles and brushes and more particularly to an improved composite bristle having a metallic inner component and a polymeric outer component.

2. Description of the Related Art

The prior art has known many types of brushes and brush bristles for use in various the applications. One important type of brush includes rotary brushes characterized by a central hub with a multiplicity of bristles extending radially outwardly from the central hub. Upon rotation of the central hub, the multiplicity of bristles rotate about the central hub to provide a wiping movement to a surface. Such type of rotary brushes are used for cleaning large surfaces application including industrial applications, airport landing strips, highways, parking lots, streets and the like. When a large rotary brush is adapted for cleaning a large surface area such as set forth above, the large rotary brush is mounted on a land vehicle such as a truck, tractor or the like. The following United States patents are representative of rotary cleaning machine of the prior art.

U.S. Pat. No. 3,005,274 discloses an apparatus for removing ballast from cribs between crossties of a railroad track comprising a mainframe having wheels to ride on the track and a digging implement frame over the crossties. A brush like digging unit is mounted for rotation on the implement frame on an axis generally normal to the crossties and having flexible members that extend below the crossties to dig ballast from the cribs. The implement frame is supported on the same from the upper surface of the crossties for moment across the crossties from one crib to the next.

U.S. Pat. No. 3,228,053 discloses a brush strip comprising an elongated flat metal plate having a series of apertures space there long. Metal collars having inner ends are integral with the plate around the apertures and have free ends extending outwardly on one side only of the plate. Tufts of bristles extend through the collar and the apertures. The bristles have free ends projecting beyond the free ends of the collars and looped ends projecting beyond, the other side of the plate. A retaining rod engages against the other side of the plate and extends through the looped end of the bristles. Elastomeric tubes surround the tufts of bristles along part of the length thereof. The tubes have inner end portions engaging between the tufts of bristles and the collars and the other end portions extending outwardly from the free ends of the collars and terminating between free ends of the collar and free ends of the bristles. The core assembly mounts the strips for rotation about an axle comprising a tube and a plurality of supports affixed in axially spaced relation along the tube. Means on the supports define a plurality of open-ended guideways for the strips. The guideways extend parallel to the axis at intervals spaced circumferentially about the arc of a circle. The means defining the guide ways each has a pair of opposed sides extending radially of the tube and angularly space from one another by distances greater than the width of the plates. Radial spaced elements extend substantially in the circumferential direction of the circle from inner and outer ends of the side surfaces, respectively. The stop elements at the outer ends of the side surfaces of each guideway terminates in an edge disposed toward and space from another by distances less than the width of the plates in greater than the diameter of the collars thereby providing clearance therebetween for the collars. The radial spacing of the stop elements are less than the distance between the other sides of the plates and the free ands of the collars whereby the collars and tubes protect the bristles from engagement against the stop surfaces at the outer ends of the side surfaces in the outer end portions of the tubes resiliently support the bristles against the bending about short radii adjacent to the free end of the collars.

U.S. Pat. No. 3,237,232 discloses a method of replacing worn gear teeth on a gear circle of the type having an annular metallic member enclosing a free on obstructed space. The annular metallic member has radially inwardly extending gear teeth at the inner periphery thereof. The method comprises forming a plurality of tooth metallic arcuate segments each having an outer periphery having a radius of curvature greater than the radius of curvature of a circle drawn through the points of connection of the teeth of the gear circle to the annular metallic member. Each of the segments has teeth of identical pitch to those carried by the gear circle. The segments collectively form a circle when placed in substantially end-to-end relationship to each other. All of the gear teeth are cut away from the gear circle by cutting through the gear circle along an annular reference line having a radius larger than the radius of curvature of the outer periphery of the arcuate segments. The arcuate segment is positioned in end-to-end circular array inside the outer peripheral portion of the gear circle in place of the removed inner peripheral portion thereof. The arcuate segments are secured to the outer peripheral portions of the gear circle while maintaining the circular array of the segments.

U.S. Pat. No. 3,649,984 discloses a bristle element especially adapted for use in a broom machine for a railway roadbed or track. The bristle elements are replaceably mounted on a mandrel rotatable on a horizontal axis. The bristle elements have a core made of a bundle of parallel straight spring-steel splines or wires fixed together at one end in a detachable coupling and encased in a resilient sheath which binds the splines into mutually supporting relation and distributes flexing stress in them away from their fixed end.

U.S. Pat. No. 4,144,610 discloses a bristle for mounting on a rotatable drum or shaft to form a sweeping device for use in maintaining railroad rails, ties, ballast and way. The bristle contains a length of wire rope with a lubricant within the interstices of the wire and strands of the rope. A low density polyethylene jacket is high compression extruded onto the exterior and into the intersticial area of the length of wire rope thereby containing and permanently sealing the lubricant within the wire rope, increasing the longitudinal stiffness of the rope, and effecting a mechanical interlock between the wire rope and the polyethylene jacket which both secures the strands of the rope together and secures the polyethylene jacket to the rope. A polyurethane jacket is extruded onto the exterior of the polyethylene jacket thereby stiffening the wire rope and polyethylene jacket, protecting the same from abrasion and cutting, and preventing splaying, unraveling or flaring of the bristle.

U.S. Pat. No. 4,184,223 discloses a sweeper bristle element adapted for use on a railway roadbed or track cleaner employing a rotating drum with element support means. The sweeper bristle element is comprised of a solid elastomeric stem preferably made of 80 durometer rubber. The stem extends substantially the length of the element and has upper and lower portions. A solid weighting mass forming a forward wearing surface and preferably made from 60 durometer rubber is attached to the lower portion of the stem. The upper portion of the stem engages the element support means and rotation of the drum imparts a centrifugal force on the stem and the knob causing loose material that contacts the element to be driven away from the element. The stem and knob are reinforced by fabric or spring steel. In a preferred embodiment, the knob and stem form a laminated, integral structure.

U.S. Pat. No. 4,285,737 discloses a method for clearing a railway roadbed of loose material employs elongate sweeper bristle elements, each element comprising a stem terminating in a knob portion which functions as a solid weighting mass and which forms a forward wearing surface. The method includes the steps of rotating a plurality of the sweeper bristle elements over the railway roadbed to be cleared so that the ends of the elements contact the loose material; imparting a centrifugal force on the stem and knob; and striking the loose material with the knob, thereby causing the loose material which contacts the knob to be driven away from the element. The preferred sweeper bristle elements are each comprised of a solid elastomeric stem preferably made of 80 durometer rubber. The stem extends substantially the length of the element and has upper and lower portions. A solid weighting mass forming a forward wearing surface and preferably made from 60 durometer rubber is attached to the lower portion of the stem. The upper portion of the stem engages a rotating drum. The rotation of the drum imparts a centrifugal force on the stem and the knob causing loose material that contacts the element to be driven away from the element.

U.S. Pat. No. 4,484,373 discloses an improved sweeper bristle element is disclosed especially adapted for use on a railway roadbed or track cleaner using a rotating drum onto which a plurality of bristles are fixedly supported. Each bristle element preferably includes an elastomeric stem of 80 durometer hardness with a toe of 60 durometer hardness wrapped around the end and one side of the stem. Rotation of the drum imparts centrifugal force on the bristles causing loose material contacting the toes thereof to be driven away. The stem and toe may be reinforced by fabric and/or spring steel and preferably are laminated together in a vulcanization process. The bristles are formed in a paddle-like configuration that increases the structural strength thereof and makes them simple to install on the drum. If desired, the bristle toe portion may be slitted to render the bristle adaptable to tight situations while maintaining the structural advantages of the paddle-like configuration.

U.S. Pat. No. 4,619,217 discloses an apparatus for cleaning underwater surfaces including at least one rotatable brush and pump for producing a stream of water from the front to the rear thereof. The brush and pump are axially reciprocable in a housing. The brush has bundles of bristles, each bundle having a head portion fitted into notches at the periphery of a main ring and held therein by a pinch ring, the main and pinch rings together constituting a brush base which is detachably secured to a rotatable base associated with the pump, by means of a pair of fixed members which are engagable upon relative rotation of the rotatable base and brush base.

U.S. Pat. No. 5,540,004 discloses an apparatus for removing ice and snow from a surface consisting of a support frame and a elongate member rotatably mounted on the support frame. The elongate member has a first end and a second end. A plurality of flexible arms extend from the elongate member in a substantially helical pattern. Upon rotation of the elongate member the arms violently strike a ground surface to dislodge packed snow and ice which is then carried by the helical pattern of the arms from the first end of the elongate member toward the second end.

Large rotary brushes for use cleaning large surfaces application are normally have a multiplicity of bristles formed from a metallic material or a multiplicity of bristles formed from a polymeric material. Each of these types of multiplicity of bristles has certain advantages over the other.

Large rotary brushes utilizing a multiplicity of bristles formed from a metallic material have the advantage of having an abrasive quality. Large rotary brushes utilizing a multiplicity of bristles formed from a polymeric material have the advantage of being stiffer than the multiplicity of bristles formed from a metallic material.

In an effort to combine the benefits of bristles formed from a metallic material and bristles formed from a polymeric material, the prior art has provided brushes having a multiplicity of bristles formed from a metallic material interposed between a multiplicity of bristles formed from a polymeric material. It would be desirable to combine the advantages of a metallic bristle and the advantages of a polymeric material in a single composite bristle. Unfortunately, none in the prior art have provided a composite wrestle having an inner metallic component and an outer polymeric component.

Therefore it is an object of this invention to provide a composite bristle having a metallic bristle inner component and a polymeric bristle outer component.

Another object of this invention is to provide an improved composite bristle that may be manufactured at a commercially economic price.

Another object of this invention is to provide an improved composite bristle that may be incorporated into various rotary cleaning machines.

Another object of this invention is to provide an improved composite bristle that may be adapted to rotary hubs of the prior art.

Another object of this invention is to provide an improved composite bristle with an extended life relative to large rotary brushes of the prior art.

Another object of this invention is to provide an improved composite bristle with superior cleaning characteristics.

The foregoing has outlined some of the more pertinent objects of the present invention. These objects should be construed as being merely illustrative of some of the more prominent features and applications of the invention. Many other beneficial results can be obtained by modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved composite bristle comprising a polymeric bristle extending from a proximal end to a distal. A metallic bristle extends from a proximal end to a distal end. The metallic bristle is embedded within a generally central region of the polymeric bristle. A periodic bend is formed within the polymeric bristle and the metallic bristle.

In a more specific example of the invention, the polymeric bristle is formed from a polypropylene material. Preferably, the polymeric bristle is extruded about the metallic bristle. The metallic bristle is formed from a steel material. The periodic bend maintains the position of the metallic bristle relative to the polymeric bristle.

The invention is incorporated further into a composite brush comprising a brush mounting. A multiplicity of composite bristles are affixed the brush mounting to form the composite brush. Each of the composite bristles comprises a metallic bristle embedded within a generally central region of a polymeric bristle. A periodic bend is formed along the length of each of the composite bristles.

The invention is incorporated further into the method for forming a composite bristle comprising the steps of passing a metallic wire through an extrusion die. A polymeric material is extruded about the metallic wire. The extruded polymeric material is cooled to provide a composite wire. A periodic bend is formed in the composite wire. The composite wire is severed in lengths to form the composite bristle.

The invention is incorporated further into the method for forming a method for forming a composite brush comprising the steps of passing a metallic wire through an extrusion die. A polymeric material is extruded about the metallic wire. The extruded polymeric material is cooled to provide a composite wire. A periodic bend is formed in the composite wire. The composite wire is severed in lengths to form the composite bristle. The multiplicity of composite bristles are affixed to a brush mounting to form the composite brush.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
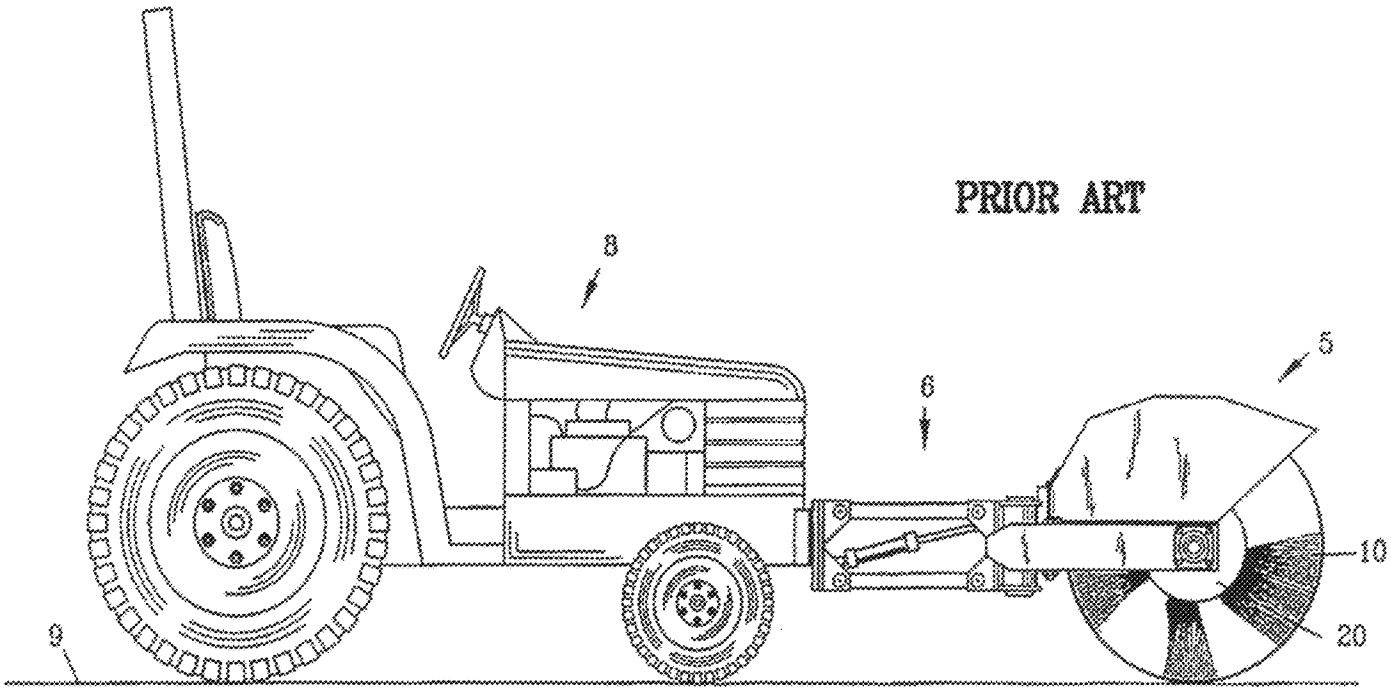
FIG. 1 is a side view of a rotary bush of the prior art coupled to a land vehicle.

FIG. 1 is a side view of a rotary bush assembly 5 of the prior art connected by a coupling 6 to a movable vehicle 8 shown as a tractor. The movable vehicle 8 is shown located on a surface 9. The bush assembly 5 comprises a brush 10 having a brush mounting 20. The coupling 6 moves the rotary bush assembly 5 relative to the movable vehicle 8 to position the brush 10 relative to the surface 9.

Figure 2:
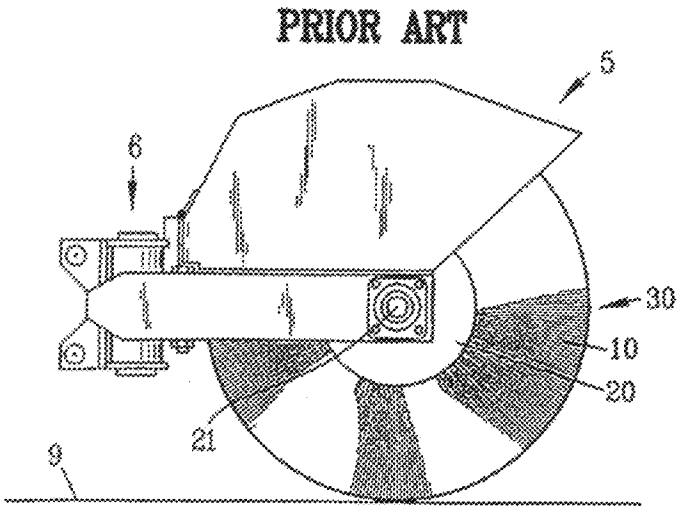
FIG. 2 is an enlarged view of the rotary bush of FIG. 1.

FIG. 2 is an enlarged view of the rotary bush of FIG. 1. In this example, the brush mounting 20 is shown as a general cylindrical mounting 20 for rotation about a cylindrical axis 21. The general cylindrical mounting 20 is rotated about the cylindrical axis 21 by suitable means such as an air motor, an electric motor, a hydraulic motor an internal combustion engine or the like (not shown) as should be well known by those skilled in the art.

Figure 3:
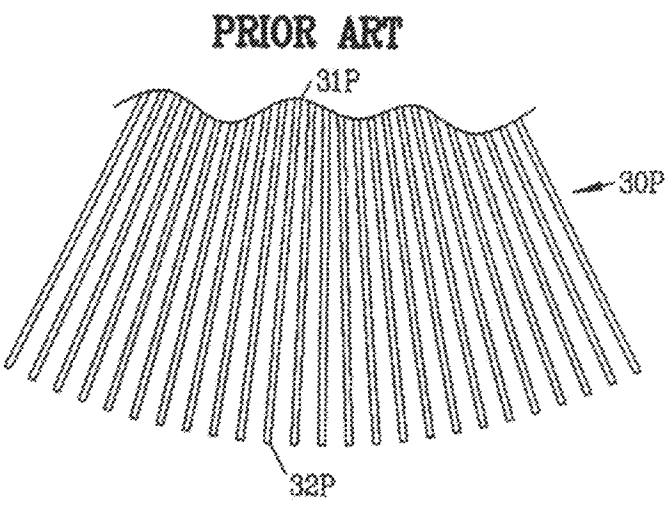
FIG. 3 is a magnified view of a first example of prior art polymeric brush bristles for the rotary bush of FIG. 2.

FIG. 3 is a magnified view of a first example of prior art polymeric brush bristles 30P for the rotary bush 10 of FIG. 2. Each of the multiplicity of bristles 30P extends from a proximal end 31P to a distal end 32P. The proximal end 31P of each of the bristles 30P is connected to the brush mounting shown in FIG. 2. The proximal ends 31P of the multiplicity of bristles 30P are connected to the brush mounting 20P any the suitable means as should be well known by those skilled in the art.

Figure 4A:
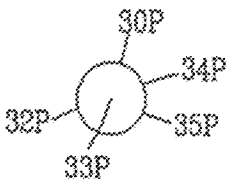
FIG. 4A is an enlarged end view of FIG. 4.
Figure 4:
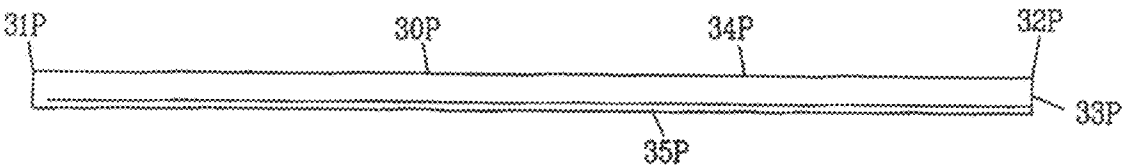
FIG. 4 is a magnified view of one of the polymeric brush bristles shown in FIG. 3.

FIGS. 4 and 4A are magnified views of one of the polymeric brush bristles 30P shown in FIG. 3. The polymeric bristle 30P has a generally circular cross-section having a center 33P and an outer surface 34P. The polymeric bristle 30P has a substantially constant diameter 35P between the proximal end 31P and the distal end 32P. The bristle 30P shown in FIGS. 3, 4 and 4A are formed from a polymeric material such as polypropylene and the like.

Figure 5:
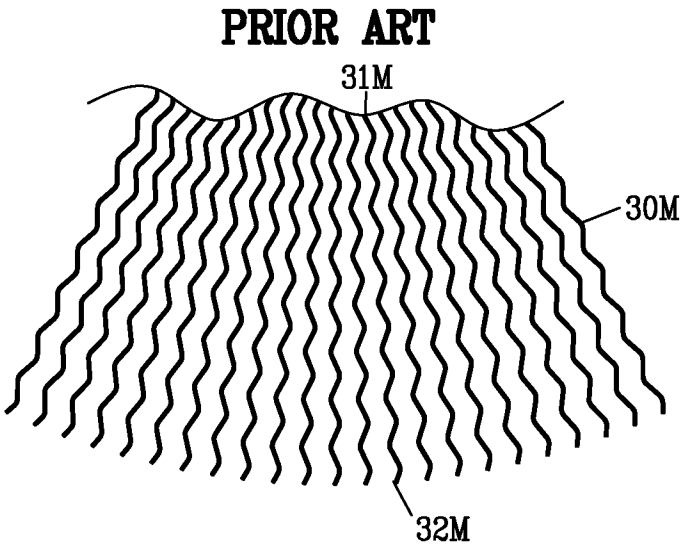
FIG. 5 is a view similar to FIG. 3 illustrating a second example of prior art metal brush bristles for the rotary bush of FIG. 2.

FIG. 5 is a view similar to FIG. 3 illustrating a second example of prior art metal brush bristles 30M for the rotary bush 10 of FIG. 2. Each of the multiplicity of bristles 30M extends from a proximal end 31M to a distal end 32M. The proximal end 31M of each of the bristles 30M is connected to the brush mounting shown in FIG. 2.

Figure 6A:
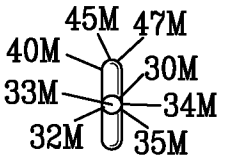
FIG. 6A is an enlarged end view of FIG. 6.
Figure 6:
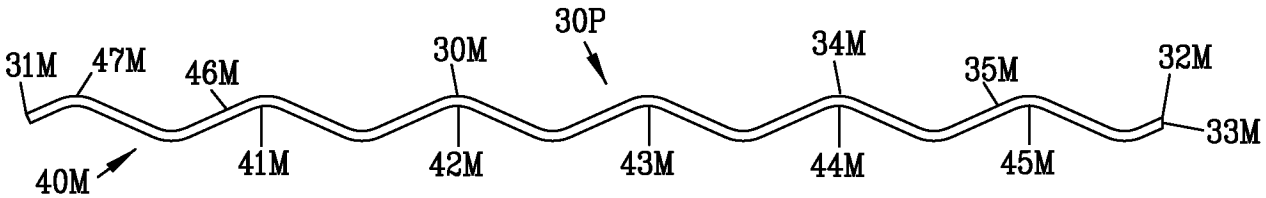
FIG. 6 is a magnified view of one of the metal brush bristles shown in FIG. 5.

FIGS. 6 and 6A are magnified views of one of the metal bristles 30P shown in FIG. 6. The metal bristle 30M has a generally circular cross-section having a center 33M and an outer surface 34M. The metal bristle 30M has a substantially constant diameter 35M between the proximal end 31M and the distal end 32M. The metal bristle 30M shown in FIGS. 5, 6 and 6A are formed from a metal material such as carbon steel, stainless steel and the like.

The metal bristle 30M is provided with a periodic bends 40M including periodic bends 41M-45M. The periodic bends 40 have a wavelength 46M and amplitude 47M. The periodic bends 40M add rigidity and stiffness to the metal bristle 30M.

Figure 7:
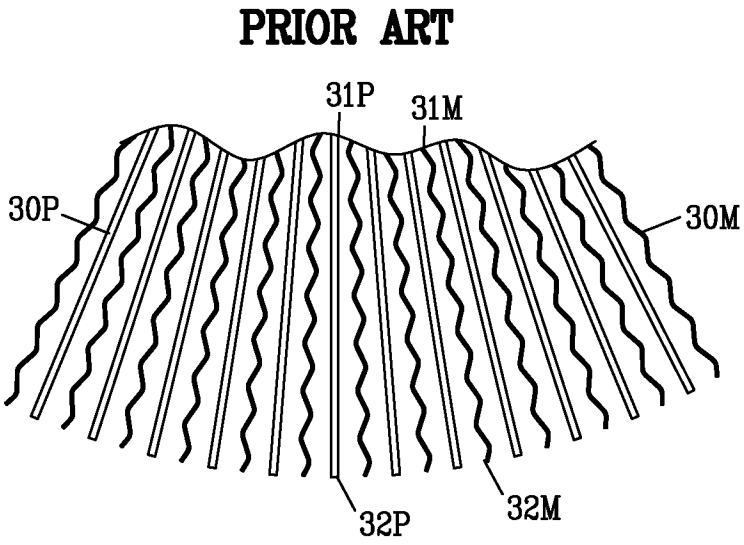
FIG. 7 is a view similar to FIG. 3 illustrating a third example of prior art brush having a mixture of polymeric bristles and metal bristles 10M for the rotary bush of FIG. 2.

FIG. 7 is a view similar to FIG. 3 illustrating a third example of prior art brush 10MP having a mixture of polymeric bristles 10P and metal bristles 10M for the rotary bush of FIG. 2. The multiplicity of the polymeric bristles 10P adds stiffness to the prior art brush 10MP. The multiplicity of the metal bristles 10M add an abrasiveness to the prior art brush 10MP.

Figure 8:
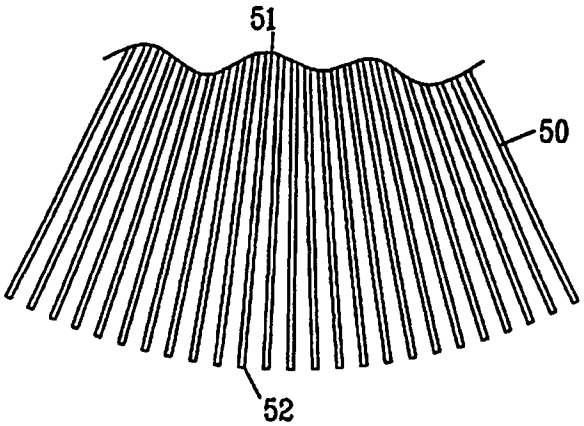
FIG. 8 is a view similar to FIG. 3 illustrating a first embodiment of the improved composite bristles of the present invention.

FIG. 8 is a view similar to FIG. 3 illustrating a first embodiment of the improved composite bristles 50 of the present invention for the rotary bush 10 of FIG. 2. Each of the multiplicity of composite bristles 50 extends from a proximal end 51 to a distal end 52. The proximal end 51 of each of the bristles 50 is connected to the brush mounting shown in FIG. 2 by any the suitable means as should be well known by those skilled in the art.

Figure 9:
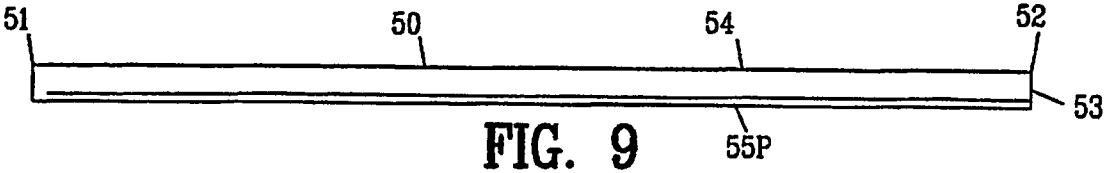
FIG. 9 is a magnified view of one of the improved composite bristles shown in FIG. 8.
Figure 9A:
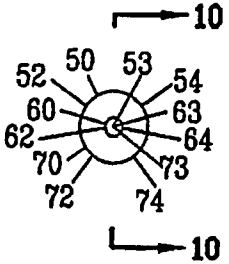
FIG. 9A is an enlarged end view of FIG. 9.

FIGS. 9 and 9A are magnified views of one of the composite bristles 50 shown in FIG. 8. The composite bristle 50 has a generally circular cross-section having a center 53 and an outer surface 54. The composite bristle 50 has a substantially constant diameter 55 between the proximal end 51 and the distal end 52. The composite bristle 50 shown in FIGS. 8, 9 and 9A are formed from a metallic bristle component 60 surrounded by a polymeric bristle component 70.

Figure 10:
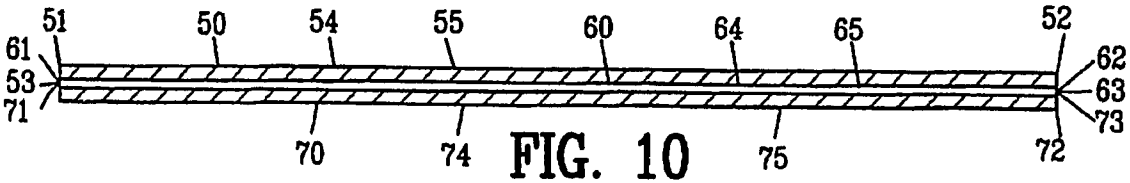
FIG. 10 is a sectional view along line 10-10 in FIG. 9A.

FIG. 10 is a sectional view along line 10-10 in FIG. 9A. The metallic composite bristle component 60 has a generally circular cross-section having a center 63 and an outer surface 64. The metallic composite bristle component 60 has a substantially constant diameter 65 between the proximal end 61 and the distal end 62. The polymeric bristle component 70 has a generally circular cross-section having a center 73 and an outer surface 74. The polymeric bristle component 70 has a substantially constant diameter 75 between the proximal end 71 and the distal end 72.

The polymeric bristle component 70 is formed about the outer surface 64 of the metallic composite bristle component 60. Preferably, the metallic composite bristle component 60 is formed from a metal material such as carbon steel, stainless steel and the like. The polymeric bristle component 70 formed from a polymeric material such as polypropylene and the like. Preferably, the polymeric bristle component 70 is formed about the outer surface 64 of the metallic composite bristle component 60 by an extrusion process. In one example, the composite bristle 50A has the dimensions (in inches) listed in Table 1:

TABLE 1

| | |
|---|---|
| composite bristle 50 | |
| diameter | 0.10 |
| metallic bristle component 60 | |
| diameter | 0.030 |
| material | high carbon steel |
| polymeric bristle component 70 | |
| diameter | 0.10 |
| material | polypropylene |

Figure 11:
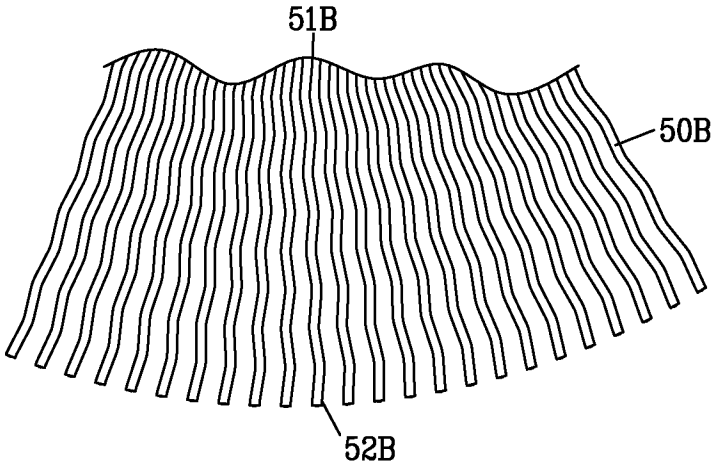
FIG. 11 is a view similar to FIG. 3 illustrating a second embodiment of the improved composite bristles of the present invention.

FIG. 11 is a view similar to FIG. 3 illustrating a second embodiment of the improved composite bristles 50B of the present invention for the rotary brush 10 of FIG. 2. Each of the multiplicity of composite bristles 50B extends from a proximal end 51B to a distal end 52B. The proximal end 51B of each of the bristles 50B is connected to the brush mounting shown in FIG. 2 by any the suitable means as should be well known by those skilled in the art.

Figure 12:
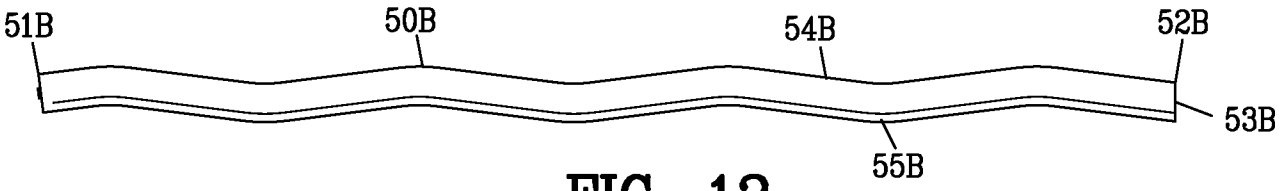
FIG. 12 is a magnified view of one of the improved composite bristles shown in FIG. 11.
Figure 12A:
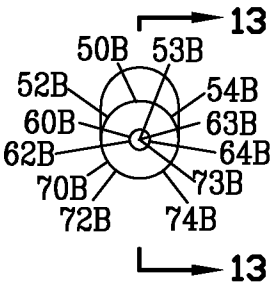
FIG. 12A is an enlarged end view of FIG. 12.

FIGS. 12 and 12A are magnified views of one of the composite bristles 50B shown in FIG. 11. The composite bristle 50B has a generally circular cross-section having a center 53B and an outer surface 54B. The composite bristle 50B has a substantially constant diameter 55B between the proximal end 51B and the distal end 52B. The composite bristle 50B shown in FIGS. 11, 12 and 12A are formed from a metallic bristle component 60B surrounded by a polymeric bristle component 70B.

Figure 13:
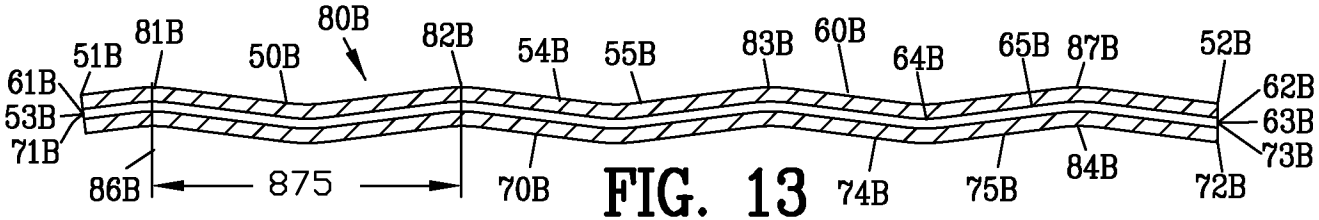
FIG. 13 is a sectional view along line 13-13 in FIG. 12A.

FIG. 13 is a sectional view along line 13-13 in FIG. 12A. The metallic composite bristle component 60B has a generally circular cross-section having a center 63B and an outer surface 64B. The metallic composite bristle component 60B has a substantially constant diameter 65B between the proximal end 61B and the distal end 62B. The polymeric bristle component 70B has a generally circular cross-section having a center 73B and an outer surface 74B. The polymeric bristle component 70B has a substantially constant diameter 75B between the proximal end 71B and the distal end 72B.

The polymeric bristle component 70B is formed about the outer surface 64B of the metallic bristle component 60B. Preferably, the metallic bristle component 60B is formed from a metal material such as carbon steel, stainless steel and the like. The polymeric bristle component 70B formed from a polymeric material such as polypropylene and the like. Preferably, the polymeric bristle component 70B is formed about the outer surface 64B of the metallic bristle component 60B by an extrusion process.

The composite bristle 50B is provided with a periodic bends 80B including periodic bends 81B-84B. The periodic bends 80B have a wavelength 86B and an amplitude 87B. In one example the composite bristle 50B has the dimensions (in inches) listed in Table 2:

TABLE 2

| | |
|---|---|
| composite bristle 50B | |
| diameter | 0.10 |
| wavelength 86B | 0.75 |
| amplitude 87B | 0.075 |
| metallic bristle component 60B | |
| diameter | 0.030 |
| material | high carbon steel |
| polymeric bristle component 70B | |
| diameter | 0.10 |
| material | polypropylene |

The periodic bends 80B provide a dual function within the composite bristle 50B of the present invention. Firstly, the periodic bends 80B add rigidity and stiffness to the composite bristle 50B. Secondly, the periodic bends 80B interlock the metallic bristle component 60B with the polymeric bristle component 70B.

Figure 14:
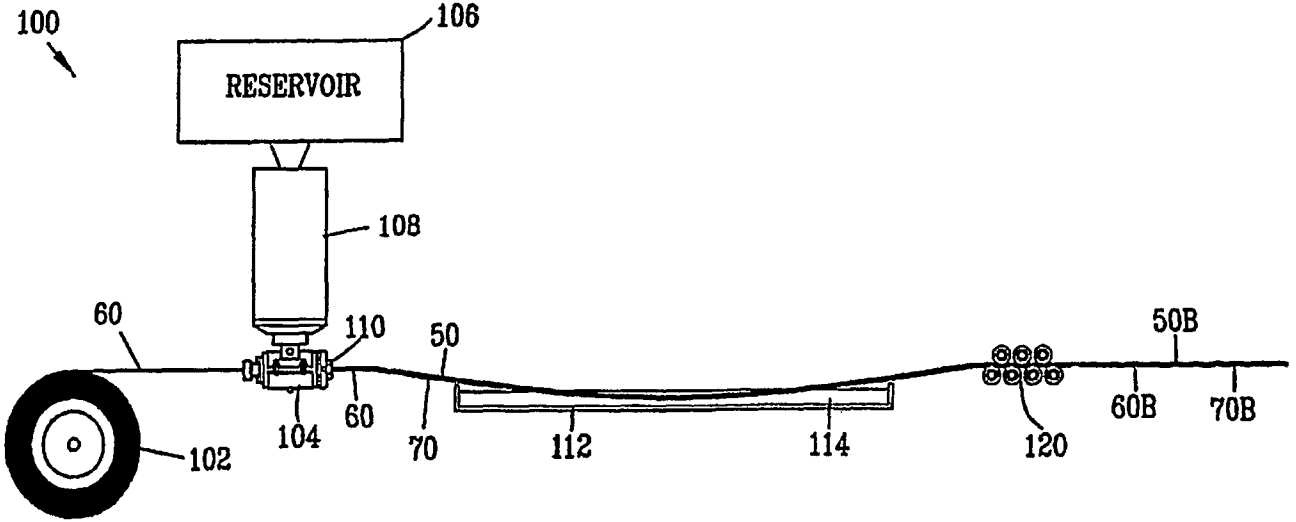
FIG. 14 is a diagram of an apparatus for forming the composite bristles of the present invention.

FIG. 14 is a diagram of an apparatus 100 for forming the composite bristles 50 and 50B of the present invention. The apparatus 100 comprises a reel 102 for feeding the metallic bristle component 60 into an extruder 104. A polymeric material is feed from a reservoir 106 by feeder 108 into the extruder 104. Preferably, the feeder 108 comprises a heated rotating screw auger for converting cool particulate polymeric material into a heated fluid polymeric material suitable for an extrusion process.

An extrusion die 110 forms the polymeric bristle component 70 about the outer surface 64 of the metallic bristle component 60 to form the composite bristle 50. The formed composite bristle 50 is passed through a cooling tank 112 filed with a cooling liquid 114. This completes the process for forming the first embodiment of the composite bristle 50 of the present invention shown in FIGS. 8-10.

The composite bristle 50 is passed through bending rollers 120 for forming the periodic bends present in the second embodiment of the composite bristle 50B of the present invention shown in FIGS. 11-13.

The present invention provides a composite bristle having a metallic bristle inner component and a polymeric bristle outer component. The composite bristle combines the advantages of a metallic bristle and the advantages of a polymeric material in a single composite bristle to provide superior cleaning characteristics. The composite bristle may be adapted to various brush types such as hand brushes as well as machine operated brushes including rotary cleaning machines.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A composite bristle, comprising;

a polymeric bristle extending from a proximal end to a distal end;

a metallic bristle extending from a proximal end to a distal end embedded and within a generally central region of said polymeric bristle; and a periodic bend formed within said polymeric bristle and said metallic bristle.

2. A composite bristle as set forth in claim 1, wherein said polymeric bristle is formed from a polypropylene material.

3. A composite bristle as set forth in claim 1, wherein said polymeric bristle is extruded about said metallic bristle.

4. A composite bristle as set forth in claim 1, wherein the metallic bristle is formed from a steel material.

5. A composite bristle as set forth in claim 1, wherein said periodic bend maintains the position of said metallic bristle relative to said polymeric bristle.

6. A composite bristle as set forth in claim 1, wherein said periodic bend includes a generally sinusoidal bend.

7. A composite bristle as set forth in claim 1, wherein said periodic bend includes a generally sinusoidal bend having of a wavelength of 0.5 to 1.0 inches.

8. A composite bristle as set forth in claim 1, wherein said periodic bend includes a generally sinusoidal bend having of an amplitude of 0.025 to 0.010 inches.

9. A composite bristle as set forth in claim 1, wherein said periodic bend includes a generally sinusoidal bend having of a wavelength of 0.5 to 1.0 inches and an amplitude of 0.025 to 0.010 inches.

10. A composite brush, comprising;

a brush mounting;

a multiplicity of composite bristles affixed said brush mounting to form the composite brush;

each of said composite bristles comprising a metallic bristle embedded within a generally central region of a polymeric bristle; and a periodic bend formed along the length of each of said composite bristles.

11. A composite brush as set forth in claim 10, wherein each of said composite bristles is secured to said brush mounting at a 180 degree bend in the composite bristles.

12. A composite brush as set forth in claim 10, wherein said brush mounting comprises a central hub.

13. A composite brush as set forth in claim 10, wherein said brush mounting comprises a central cylindrical hub.

* * * * *